United States Patent [19]

Scholz

[11] Patent Number: 4,653,973

[45] Date of Patent: Mar. 31, 1987

[54] DE-PACKAGING APPARATUS

[76] Inventor: Fred Scholz, 9S161 Aero Dr., Naperville, Ill. 60565

[21] Appl. No.: 762,262

[22] Filed: Aug. 5, 1985

[51] Int. Cl.[4] ..... B65B 69/00

[52] U.S. Cl. ..... 414/412; 198/379; 198/533

[58] Field of Search ..... 198/533, 379; 414/412

[56] References Cited

U.S. PATENT DOCUMENTS

| | | | |
|---|---|---|---|
| 2,772,009 | 11/1956 | Plusquellic | 414/412 |
| 3,386,602 | 6/1968 | Kanarek | 414/412 |
| 3,823,815 | 7/1974 | Bretten et al. | 198/397 |
| 4,149,547 | 4/1979 | Komossa et al. | 198/533 |

FOREIGN PATENT DOCUMENTS

| | | | |
|---|---|---|---|
| 2161791 | 6/1973 | Fed. Rep. of Germany | 414/412 |
| 2096089 | 10/1982 | United Kingdom | 414/412 |
| 1025591 | 6/1983 | U.S.S.R. | 414/412 |

*Primary Examiner*—Lawrence J. Oresky
*Attorney, Agent, or Firm*—Robert F. Van Epps

[57] ABSTRACT

An apparatus for automatically de-packaging products and separating the product from its package wihtout contamination of the product and having an improved, continuous feed agitating hopper, a product-orienting feed chute and being adaptable for operation without tumbling the product and package together.

1 Claim, 10 Drawing Figures

DE-PACKAGING APPARATUS

BACKGROUND OF THE INVENTION

1. Field of the Invention

The present invention relates to improvements in apparatus for separating packaged products from their containers and recovery of the products substantially free of contamination by particles of wrapper material.

2. Description of the Prior Art

The prior art for the present invention is represented by U.S. Pat. No. 3,386,602 which issued on June 4, 1968 to J. S. Kanarek for De-Packaging Apparatus and Method (Kanarek I) and U.S. Pat. No. 3,863,790, which issued to the same inventor on Feb. 4, 1975 for Wrapper Removal Apparatus (Kanarek II). The Kanarek I reference is directed to an apparatus wherein packaged products were batch fed via a hopper to rotating cutters which slit open the packages. The open packages were then delivered to a rotating, perforated drum or tumbling station to separate the product from the package. Since the packaged products are batch fed into the hopper without regard to orientation the Kanarek I apparatus exhibited a tendency to jam, particularly when boxed products were being unpackaged which required the machine to be shut down for manual clearing. The batch-feed was further a relatively slow process.

Kanarek II addressed the problem of unpackaging solid articles from wrappers and involved orienting the package product for two separate wrapper slitting operations. Separation of the product from the wrapper was still accomplished by a tumbling action. Many modern products are being packaged in materials having a core of recycled paper. A characteristic of this material is that exposed surfaces of the recycled paper tend to flake away under agitation and create an unacceptable contamination problem.

OBJECTS AND SUMMARY OF THE INVENTION

From the preceding discussion, it will be understood that among the various objectives of the present invention are included the following:

- the provision of a new and improved product de-packaging apparatus;
- the provision of apparatus of the above-described character which is capable of continuous high-speed operation;
- the provision of apparatus of the above-described character which separates product from package without tumbling;
- the provision of apparatus of the above-described character having a self-clearing feeder chute.

These and other objectives of the invention are efficiently achieved by providing a continuous feed hopper having an agitator in the lower end thereof to prevent jamming of the packaged products. Individual packaged products are delivered by a conveyor belt to a product-orienting chute whereby, particularly boxed products, are transferred to a slitting mechanism having one or more rotating cutter blades. The package is slit open and delivered to a separating mechanism wherein the product and package are separately recovered. The separating mechanism may be of the tumbler type with one or more rotating mesh drums of appropriate size to recover the product. Alternatively, a non-tumbling separating mechanism particularly useful for emptying boxes of particulate product maybe used.

The foregoing, as well as other objectives, features and advantages of the present invention will become more apparent from the following detailed description taken in conjunction with the various views of the appended drawings.

DESCRIPTION OF PREFERRED EMBODIMENT

Figure 2:
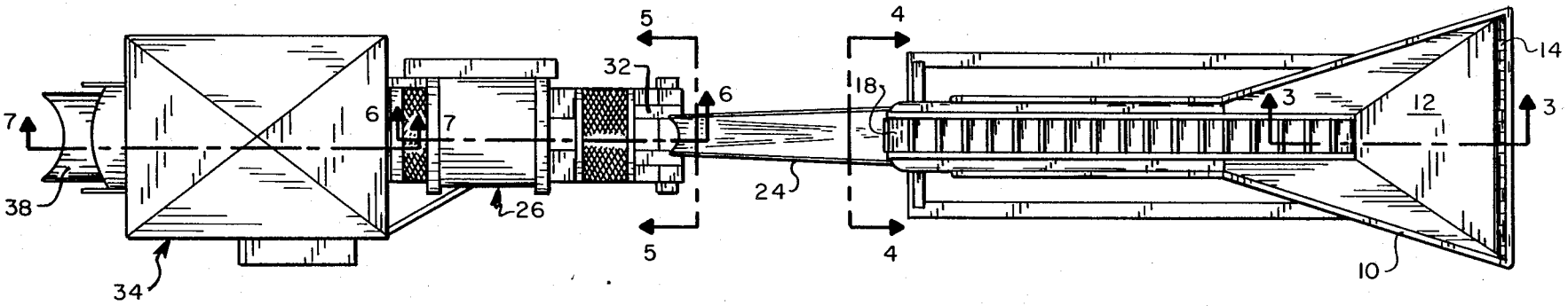
FIG. 2 is a top elevation view of the apparatus of FIG. 1.
Figure 1:
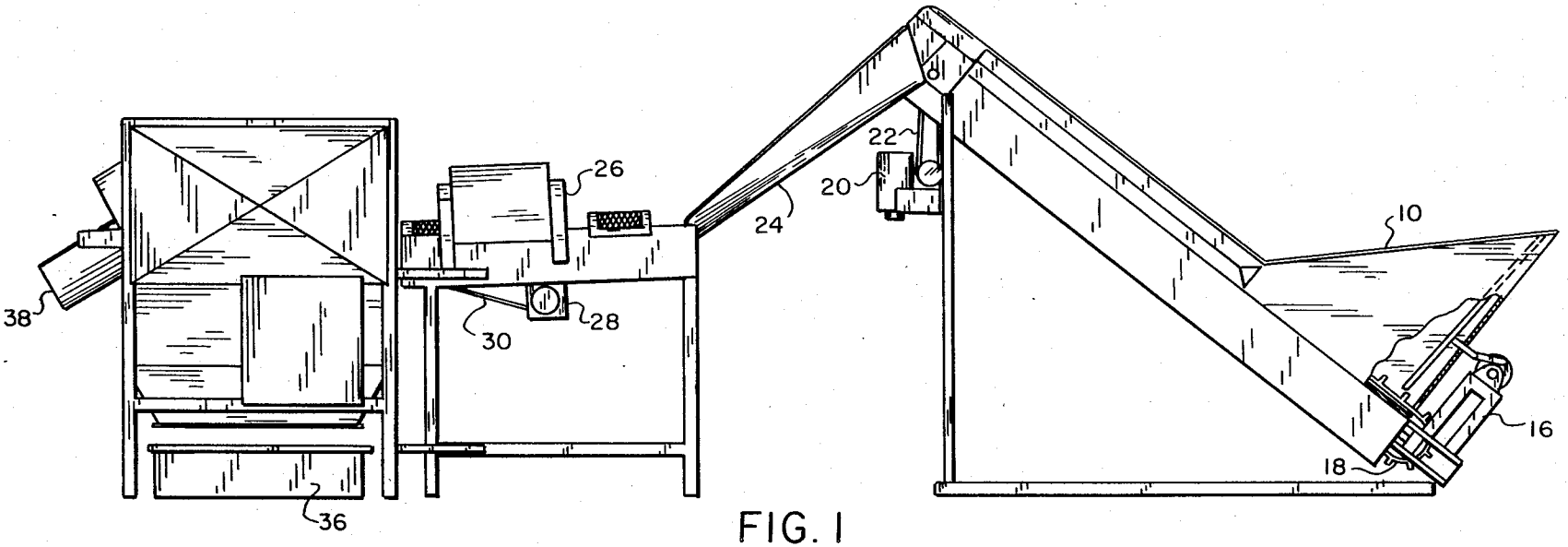
FIG. 1 is a side elevation view of a de-packaging apparatus constructed in accordance with the principles of the present invention.

Referring now to FIGS. 1 and 2 there is shown in side and top elevation views a de-packaging apparatus in accordance with the presence invention and wherein like elements are identified by like reference characters. Products to be de-packaged are dumped into a continuous feed hopper 10 which has at its lower end an agitator plate 12 coupled via hinge 14. The agitator plate 12 is driven in a reciprocating motion by an agitator drive mechanism 16. The continuous agitation of packaged products, particularly boxed products, prevents them from becoming wedged between the hopper walls. Individual packaged products are picked up by a continuous conveyor belt 18 driven by a conveyor drive motor 20 and belt 22 and delivered to a self-orienting chute 24. The configuration of the chute 24 will be more fully described hereinbelow but in operation serves to orient packaged products, particularly those in boxes, with respect to the opening mechanism 26. The opening mechanism 26 has one or more cutter blades (not shown) driven at high speed by motor 28 and drive belt 30. The packages are carried by a conveyor belt 32 through the opening mechanism where they are slit open. The opened packages are then deposited in a separating mechanism 34 which may be either of a tumbling or non-tumbling type. The product is separated from the package and recovered in a hopper 36 (or conveyor) for later re-packaging. The packaging material is separately recovered via output chute 38.

Figure 3:
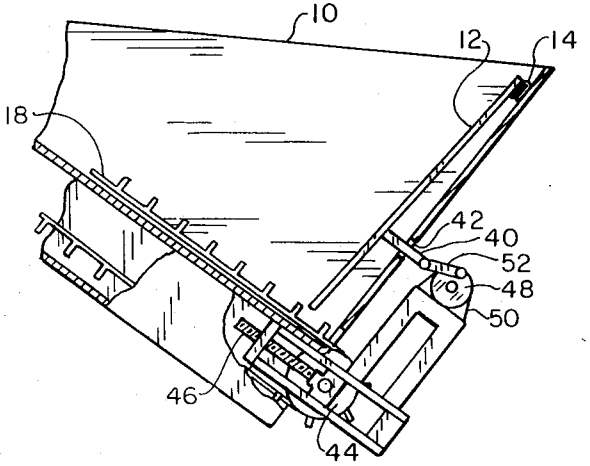
FIG. 3 is a longitudinal cross-section view of the continuous feed hopper and agitator of the apparatus of FIGS. 1 and 2.

Turning to FIG. 3 there is shown a detailed longitudinal cross-section of the agitator structure. The agitator plate 12 is coupled to the upper end of the bottom of hopper 10 by a hinge 14. An arm 40 is fixed to the back of the agitator plate 12 and extends through an aperture 42 in the bottom of the hopper 10. The continuous conveyor belt 18 passes around an idler pulley 44 and belt tension is adjustable by means of an adjustment screw 46. The idler pulley 44 is thus driven by the conveyor belt 18 and in turn drives an agitator drive wheel 48 via drive belt 50. An agitator drive arm 52 is eccentrically mounted at one end to the drive wheel 48 and at its other end to the arm 40. At any time the conveyor belt 18 is being driven the agitator plate 12 is also driven in a reciprocating motion to dislodge any packaged products which might otherwise become jammed between the walls of hopper 10.

Figure 5:
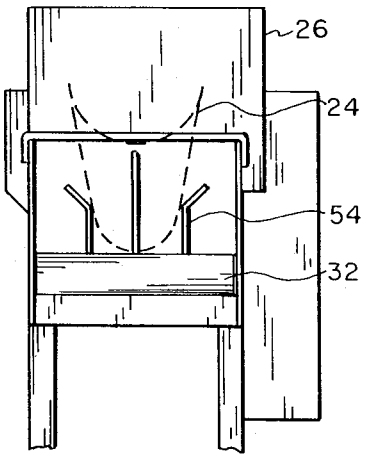
FIG. 5 is a cross-section view taken along section line 5—5 of FIG. 2.
Figure 4:
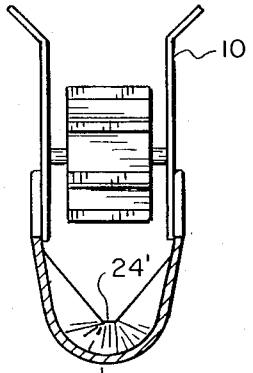
FIG. 4 is a cross-section view taken along section line 4—4 of FIG. 2.

FIG. 4 is a perspective view of the apparatus through section line 4—4 of FIG. 2 and illustrates the upper end of the conveyor belt 18 at which point the packaged products are deposited in the product-orienting chute 24. The primary feature illustrated is that the chute 24 at its upper end 24′ is of substantially a "V" configuration and over its length transitions to a "U" configuration at the lower end 24″. When a boxed product is deposited at the upper end of the chute 24 with a random orientation, the initial "V" shape causes the box to align along one of its edges with the longitudinal centerline of the chute 24. As the box slides down the chute 24, the transition to the "U" configuration allows the box to roll onto one of its major surfaces while maintaining the leading edge of the box at substantially a ninety degree angle to the longitudinal axis of the chute 24 and thus also to the conveyor belt 32 to the opening mechanism 26 of FIG. 2. Similarly FIG. 5 is a perspective view of the apparatus through section line 5—5 of FIG. 2 illustrating the relationship of the lower end of chute 24 to the conveyor belt 32 and input chute 54 of the opening mechanism 56.

Figure 6:
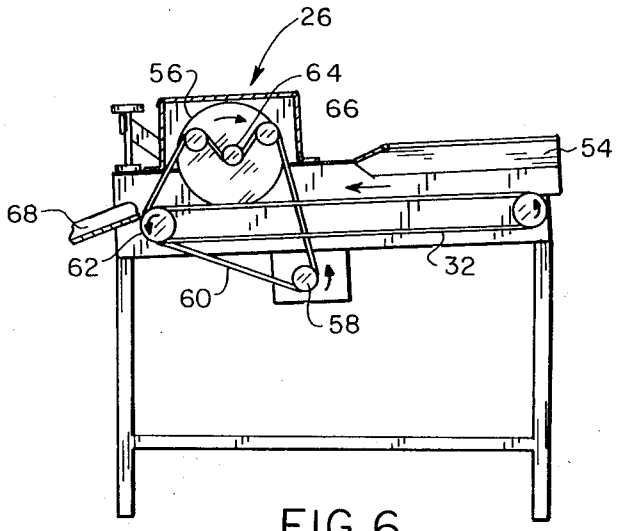
FIG. 6 is a longitudinal cross-section view of the package opening mechanism of FIGS. 1 and 2 along section line 6—6 of FIG. 2.

FIG. 6 is a longitudinal cross-section view of the opening mechanism 26 of the apparatus of FIGS. 1 and 2 through the section 6—6 of FIG. 2. The products to be de-packaged are deposited via the input chute 54 on the opening mechanism conveyor belt 32 where they are transported into one or more cutting blades 56. A single drive motor 58 and belt 60 are used to drive the conveyor belt 32 through pulley 62 and the cutting blade(s) 56 through the cutting blade spindle 64 with appropriate tension being maintained by first and second idler pulleys 66. After the package has been slit open, it is delivered by the conveyor belt 32 to an output chute 68 to the intake of the separating mechanism 34 of FIG. 2.

Figure 7:
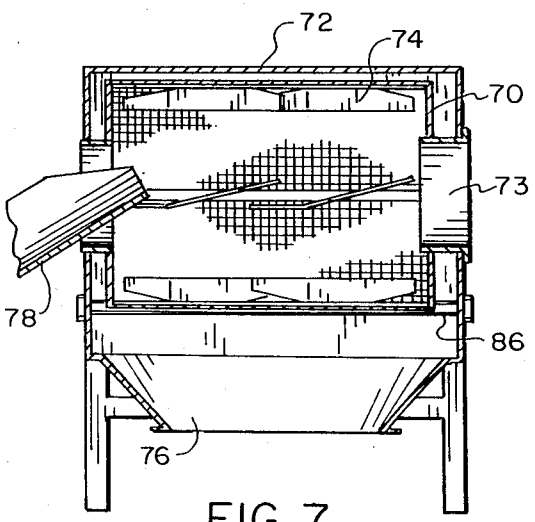
FIG. 7 is a longitudinal cross-section view of a tumbling type separating mechanism of FIGS. 1 and 2 along section line 7—7 of FIG. 2.
Figure 8:
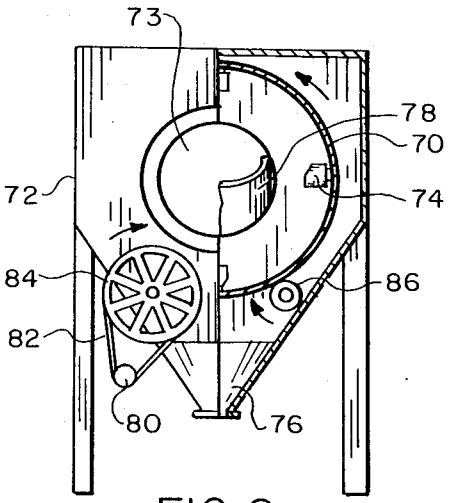
FIG. 8 is an end view, partially in transverse cross-section, of the separating mechanism of FIG. 7.

One form of separating mechanism is illustrated in the horizontal cross-section view of FIG. 7 along the section 7—7 of FIG. 2, and is particularly well suited to paper and plastic packaged products. A mesh drum 70 adapted to rotate on an idler 86 in a housing 72 has an intake 73 for receiving the slit-open packages from the output chute 68 of the opening mechanism of FIG. 6. The size of the mesh is selected according to the nature of the product to be de-packaged; i.e. a relatively fine mesh for a granular product such as sugar or coffee and a relatively larger mesh for products such as a flake cereal. As the drum 70 rotates, stirring vanes 74 on the inner surface aid in the separation of the product from its package. The product passes through the mesh drum 70 by gravity and exits the apparatus through output chute 76. The packaging material is exhausted through chute 78 for destruction or reclamation. FIG. 8 is an end view of the separating mechanism of FIG. 7 with a portion cut away and wherein like elements are identified by like reference characters. This view also illustrates the drum rotational drive mechanism including motor 80, drive belt 82, drive pulley 84 and drum idler 86.

Figure 9:
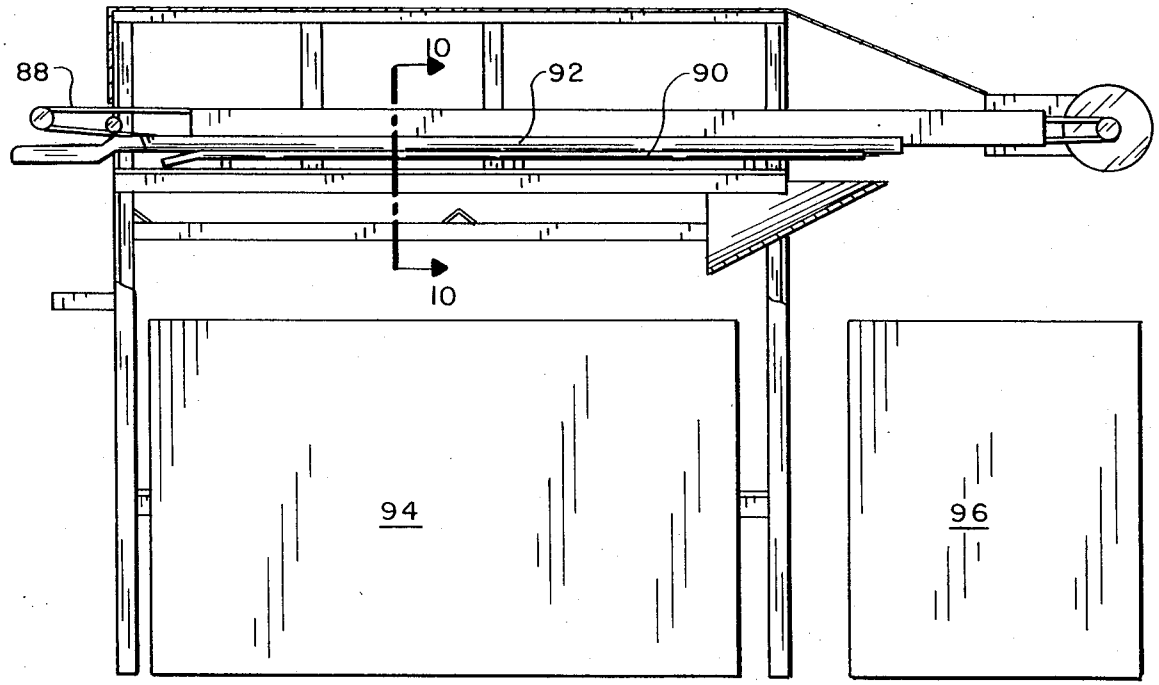
FIG. 9 is a cross-section view of an alternative non-tumbling separating mechanism.

FIG. 9 illustrates an alternative separating mechanism particularly well adapted to handle boxed products wherein it is undesirable to tumble the product with the opened package.

As the boxed product leaves the output chute 68 of the opening mechanism of FIG. 6 it is picked up by the conveyor 88 of the separating mechanism of FIG. 9. The box is carried into and between first and second converging spreader rods 90. A package stop bar 92 is disposed above and substantially along the longitudinal center line of the spreader rods 90. As the box moves through the mechanism the opposite ends of the box are driven upward by the spreader rods 90 while the centerline of the box is held in place by the stop bar 92. The box is thus effectively folded in half along its uncut upper major surface. The contents fall by gravity into a product reclamation hopper 94 or conveyor and the empty boxes are pushed on to a package reclamation bin 96.

Figure 10:
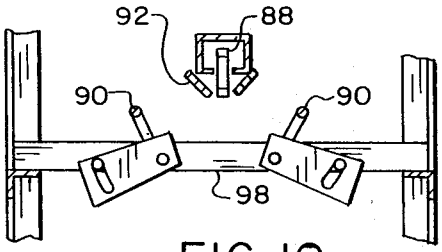
FIG. 10 is a cross-section view of the separating mechanism of FIG. 9.

FIG. 10 is a cross section view of the apparatus of FIG. 9 along the section line 10—10. There is illustrated the first and second spreader rods 90 which are adjustably mounted to the framework 98 to accommodate boxes of various sizes. Also shown is the conveyor 88 in relation to the stop bar 92.

From the foregoing it will be understood that the applicant has provided a new and improved product de-packaging apparatus wherein the objectives set forth hereinabove are efficiently achieved. Since certain changes in the above described construction will become apparent to those skilled in the art without departure from the scope of the invention, it is intended that all matter set forth in the description or shown in the various views of the appended drawings shall be deemed illustrative and not taken in a limiting sense.

Having described what is new and novel and desired to secure by Letters Patent, what is claimed is:

1. An improved apparatus for de-packaging boxed products and separating said products from its boxes, said apparatus being of the type including means for first automatically cutting said boxes through at least one major surface and two opposed edges thereof, means for separating said products from said boxes and means separately collecting said contents and said boxes, wherein said improvement comprises means for orienting said boxes relative to said cutting means such that said boxes rest upon a major surface thereof and two opposing edges thereof are presented to said cutting means at a substantially right angle, wherein said orienting means further comprises a product orienting chute extending at an upward angle from said cutting means and adapted to receive said boxed products at its upper end, said chute having substantially a "V" shaped cross section at its upper end and substantially a "U" shaped cross-section at its lower end; and, said separating means further comprises first and second spreader rods disposed in a longitudinally converging and laterally adjustable relationship to one another;

a package stop bar disposed above and substantially along the longitudinal centerline of said first and second spreader rods; and means for driving cut boxes of the product between said spreader rods and beneath said stop bar whereby said box is folded substantially in half along its uncut major surface and said product is released for collection separately from said boxes.

* * * * *